United States Patent [19]

Burrow et al.

[11] Patent Number: 4,667,897

[45] Date of Patent: May 26, 1987

[54] ARMORED CABLE DISPENSER

[76] Inventors: Charles A. Burrow, 4610 Taft St.; Edwin D. Anders, 4670 Coolidge, both of Beaumont, Tex. 77706

[21] Appl. No.: 855,403

[22] Filed: Apr. 24, 1986

[51] Int. Cl.[4] ..... B65H 49/20

[52] U.S. Cl. ..... 242/129; 242/129.8

[58] Field of Search ..... 242/129, 129.8, 105

[56] References Cited

U.S. PATENT DOCUMENTS

| | | | |
|---|---|---|---|
| 187,271 | 2/1877 | Haight | 242/129 X |
| 232,168 | 9/1880 | Beardslee | 242/129 X |
| 1,147,680 | 7/1915 | Crawford | 242/129 |
| 1,329,240 | 1/1920 | Hays | 242/129 X |
| 2,562,650 | 7/1951 | Trunkhill | 242/129 |
| 2,985,404 | 5/1961 | Tashiro | 242/129 |
| 3,072,358 | 1/1963 | Knapp | 242/129 |
| 3,127,127 | 3/1964 | Kohn et al. | 242/129 |
| 3,178,129 | 4/1965 | Parkinson | 242/129 |
| 3,275,263 | 9/1966 | Parkinson | 242/129 |
| 3,392,960 | 7/1968 | Bye | 242/105 X |
| 3,593,943 | 7/1971 | Collmann | 242/129 |
| 3,603,526 | 9/1971 | Payne et al. | 242/129.8 |
| 3,831,877 | 8/1974 | Bennett et al. | 242/129 X |
| 4,015,795 | 4/1977 | Chong | 242/129 |
| 4,184,647 | 1/1980 | Rourke | 242/129.8 X |
| 4,208,021 | 6/1980 | Wall | 242/129 X |
| 4,471,921 | 9/1984 | Corbin | 242/105 X |

*Primary Examiner*—Stanley N. Gilreath
*Attorney, Agent, or Firm*—Walter C. Farley

[57] ABSTRACT

An armored cable dispenser includes a base, a drag plate fixedly attached to the base, a shaft extending upwardly from the base and a tray rotatably resting on the drag plate and surrounding the shaft. An annular rail is supported above the tray on vertical supports which contain a coil of cable on the tray. A central tube around the shaft supports a lid the edge of which defines an annular gap with the rail through which cable can be pulled. A removable lock holds the lid in place.

4 Claims, 5 Drawing Figures

ARMORED CABLE DISPENSER

BACKGROUND OF THE INVENTION

This invention relates to a free-standing floor mounted unit for dispensing coiled armored cable and related products. The wiring and general construction industries are primary areas for use of such a dispenser because of their particular need for pulling electric armored cable from the dispenser for commercial and industrial electrical construction. This is done by laying the dispenser on the floor and pulling the cable out to pass it through metal or wood studs or any structure that will hold the cable.

Typically, electric armored cable is manufactured and placed in coils with bands applied to keep them in place. These coils meet the need for long lengths and provide a means for the electrician to have minimal waste of labor and of armored cable. Electricians install armored cable for commercial and industrial construction for supplying electricity to wiring devices, lighting fixtures, power breaker panels, air conditioning, heating and computers. To facilitate the ease and speed of installation of such armored cable, it is desirable to place the coils on the dispenser so that the cable can be payed out easily and quickly to wire the building or plant.

To facilitate the maximum ease of pulling armored cable from the dispenser, the unit provides flexibility, portability and labor savings for the electrician. This dispenser is easy to transport and can be used again and again.

SUMMARY OF THE INVENTION

An object of the present invention is to provide a portable armored cable dispenser that is easy to set up or take down and which is compact for storage and is small enough for easy transportation.

Accordingly, the present invention contemplates a dispenser for paying out armored cable manufactured in hand coils and includes three parts, namely a lid, tray, and base. All of these are constructed of hard and heavy duty material.

The lid of the present invention is made removable for easy access to the tray section. Once the lid is removed the armored cable may be placed on the tray and the lid can be lowered into place. A lock is provided on the top of the lid to facilitate holding down the armored cable as it is payed out, and also forces the cable to stay in its original coiled manner.

The tray of the present invention receives the armored cable for pay out. This tray is of sufficient size to handle coils of armored cable and has a retaining rail around the entire tray. This rail is to keep armored cable from falling off the tray and to help pay out the armored cable uniformly.

The base of the present invention receives both lid and tray on a shaft rising up through the center of both. The tray rests on a drag pad or plate that both steadies and causes pay out of the armored cable at the desired speed in either direction. A sturdily built base helps prevent the unit from being dragged and facilitates a unit that hugs the floor or surface it is resting on.

This unique dispenser saves labor time, set up time and can be used job after job.

BRIEF DESCRIPTION OF THE DRAWING

The novel features of mounting and holding a coil of armored cable with the present invention will be more readily understood when considered with the following description taken together with the accompanying drawings, in which a preferred embodiment is illustrated with various parts thereto identified by suitable reference characters in each of the views in which.

DETAILED DESCRIPTION OF THE PREFERRED EMBODIMENT

Figure 2:
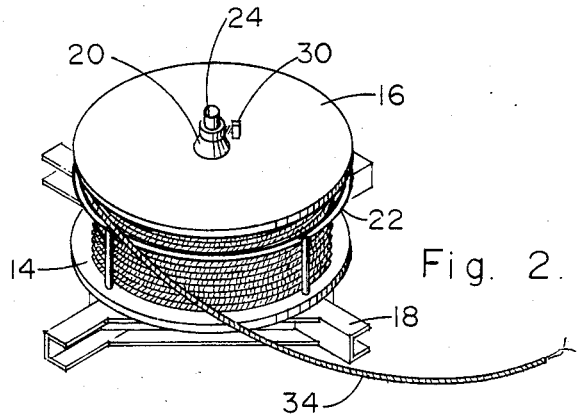
FIG. 2 is a view similar to FIG. 1 but illustrates armored cable loaded on the present invention.
Figure 5:
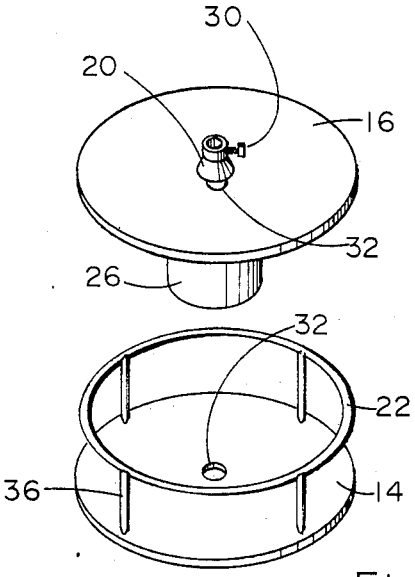
FIG. 5 is an exploded view of the dispenser of the present invention showing all three parts of the present invention, and their interconnection.

Referring to the drawings, and more particularly to FIGS. 2 and 5, the dispenser in accordance with the present invention includes a circular tray 14 which can travel in both the clockwise and counterclockwise directions and which rests on the drag plate 28. The tray 14 in use will be loaded with a coil of metallic or insulated armored cable to be payed out at the desired speed. Tray 14 has a horizontal tray rail 22 which is supported on the tray by several vertical members 36. This rail structure keeps armored cable from falling off of the tray 14. FIG. 2 shows this dispenser loaded with armored cable 34. FIG. 5 shows the dispenser having been disassembled into basically three parts: lid 16, tray 14, and base 18.

Figure 1:
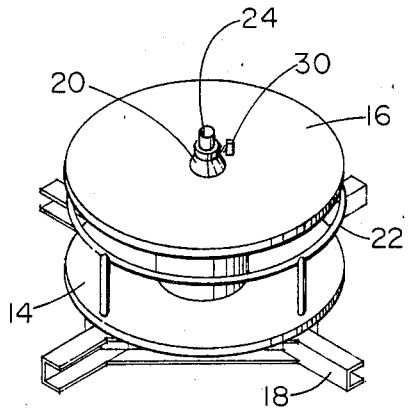
FIG. 1 is a perspective view showing lid, tray and base.

With reference now directed particularly to FIG. 1, the dispenser lid 16 has a shaft 24 passing through an opening 32 in the center, the lid being locked into place on the shaft after being loaded with armored cable by releasable and removable lock 20, the lock having a means for engaging the shaft 24 comprising a bolt 30.

Figure 3:
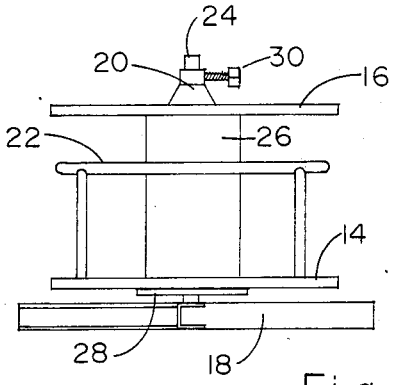
FIG. 3 is a side view of the dispenser of FIG. 1 ready to remove the lid for loading.
Figure 4:
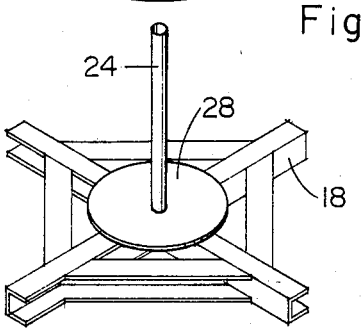
FIG. 4 is a top view of the apparatus of FIG. 3 showing the lid and its lock feature for holding the lid down.
Figure 4:
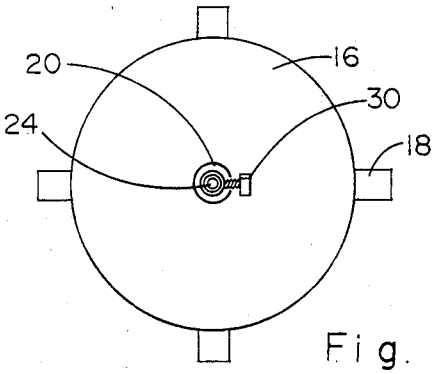

FIG. 3 shows a side view of the present invention. This shows inner retainer 26, which allows steady and smooth pay out of cable 34. The cable is normally supplied in the form of a coil with a round void in the center through which inner retainer 26 extends to keep cable 34 evenly distributed on the tray 14. Lid 16 is attached to retainer 26 and forces smooth pay out of cable 34 and keeps the cable from uncoiling when the bands are cut from the factory packaging of cable 34. FIG. 3 also shows how tray rests on drag plate 28, which is designed with a surface area of sufficient size to not only support the tray 14, but also have the required friction between tray 14 and drag plate 28, to force pay-out of cable 34 at a speed required by electricians without the threat of back lash of cable 34. FIG. 4 shows lid 16 in place and lock 20 securely fastened by bolt 30.

FIG. 5 shows the dispenser in three parts, showing how it may be disassembled. After considering the description of lid 16 and tray 14, now the base 13 is described. Base 13 is constructed of heavy duty metal and built to withstand heavy loads. The base has an axle shaft 24 fixedly attached to drag plate 28 and base 18. This shaft 24 is placed in the center of the present invention and is of sufficient height to accept lid 16 and have enough exposed shaft 24 for a secure lock 20 after being loaded.

Advantageously, the present invention helps electricians to easily pay out armored cable 34 at a required speed due to drag plate 28. If the electrician does not use all of cable 34, he may use tray 14 as a holder for unused cable for the next time he needs to use it. Tray 14 travels in both directions in a circular motion for pay out of retraction of the armored cable 34. The tray rail 22, is of sufficient height above tray 14 so as to allow a space or gap that is perfectly sized between tray 14 and lid 16 for quick and easy pay out.

From the above, it can be appreciated that the dispenser of the present invention is compact and readily transportable and versatile enough to be transported as one piece or carried in pieces. It is os size so that it may be situated in areas of limited accessability. As such, it may also be transported from various working areas within a building or from jobsite to jobsite without requiring excessive space or manpower to handle it.

What is claimed is:

1. An armored cable dispenser for receiving and controlling the dispensing of armored cable coiled into a generally toroidal shape, the dispenser comprising a base having a top and a bottom adapted to rest on a supporting surface;

a drag plate mounted on top of said base and positioned to be substantially horizontal when said base rests on a substantially horizontal supporting surface;

an axle shaft attached to said base and extending upwardly from the top thereof through said drag plate;

a substantially planar tray rotatably resting on said drag plate, said tray having a central opening through which said shaft extends;

a railing mounted on said tray for rotation therewith, said railing including an annular horizontal rail member and means for supporting said rail member in spaced relationship above said tray;

a generally planar lid having a circular edge and a central opening through which said shaft extends;

a guide tube surrounding said shaft and extending between said tray and said lid to define an annular gap between the edge of said lid and said horizontal rail member through which armored cable can pass, said guide tube being dimensioned to pass through and substantially occupy a central opening of the coiled armored cable.

2. a dispenser according to claim 1, wherein said drag plate is a circular plate of smaller diameter than said tray and is fixedly attached to said base.

3. A dispenser according to claim 1, wherein said gap defined by said lid and horizontal rail member extends entirely around said dispenser.

4. A dispenser according to claim 3 and further including lock means for restraining said lid against axial movement on said shaft.

* * * * *